US011603625B2

(12) United States Patent
Noel

(10) Patent No.: US 11,603,625 B2
(45) Date of Patent: Mar. 14, 2023

(54) CART COAT FOR LAUNDROMAT CARTS AND ASSOCIATED SYSTEMS AND METHODS

(71) Applicant: Melodie Grace Noel, Norcross, GA (US)

(72) Inventor: Melodie Grace Noel, Norcross, GA (US)

( * ) Notice: Subject to any disclaimer, the term of this patent is extended or adjusted under 35 U.S.C. 154(b) by 277 days.

(21) Appl. No.: 16/870,293

(22) Filed: May 8, 2020

(65) Prior Publication Data

US 2021/0348322 A1 Nov. 11, 2021

(51) Int. Cl.
*D06F 95/00* (2006.01)

(52) U.S. Cl.
CPC ..... *D06F 95/004* (2013.01); *D06F 95/006* (2013.01); *D06F 95/008* (2013.01)

(58) Field of Classification Search
CPC .... D06F 95/004; D06F 95/006; D06F 95/002; D06F 95/008; B32B 3/06
USPC ..... 29/525.03; 428/43, 99, 100, 150, 154
See application file for complete search history.

(56) References Cited

U.S. PATENT DOCUMENTS 2,761,480 A * 9/1956 Tames ..... D06F 95/004 383/6
3,369,584 A * 2/1968 Faccio ..... D06F 95/004 383/7
4,822,178 A * 4/1989 Taylor ..... D06F 95/004 383/33
5,078,508 A * 1/1992 Johan ..... B65F 1/0006 383/119
5,394,565 A * 3/1995 Stewart ..... A63H 33/00 446/28
5,410,758 A * 5/1995 Dupont ..... A41D 13/1209 2/901
5,503,476 A * 4/1996 Hamdan ..... D06F 95/002 383/86.2
5,540,501 A * 7/1996 Franco ..... D06F 95/004 D32/36
5,795,282 A * 8/1998 deMunnik ..... B65D 5/62 112/475.08
5,809,576 A * 9/1998 Huston ..... A41D 27/20 2/248
5,817,379 A * 10/1998 Rich ..... D06F 95/006 383/4
6,224,152 B1 * 5/2001 Hughes ..... A47D 15/006 297/219.12
6,233,747 B1 * 5/2001 Barker ..... A41D 27/20 2/247
6,308,875 B1 * 10/2001 Almo ..... A61B 50/20 224/660
6,428,098 B1 * 8/2002 Allbaugh ..... A47D 1/00 297/219.12

(Continued)

*Primary Examiner* — Nkeisha Smith

(57) ABSTRACT

A cart coat adapted to seat within a laundromat cart includes an outer layer and an inner layer. The outer layer defines an inner surface and an outer surface of the cart coat, and the outer layer further defines a pouch. The inner layer is retained within the pouch and can be detachable or removable from the outer layer. The inner layer includes a health protection material. A cart coat transport system may include the cart coat and an article of apparel configured to be worn on an upper part of a wearer's body. The cart coat is selectively attachable to the article of apparel.

10 Claims, 9 Drawing Sheets

(56) References Cited

U.S. PATENT DOCUMENTS 6,491,996 B2 * 12/2002 Digangi ..... B32B 27/32 297/229
6,759,006 B1 * 7/2004 Siklosi ..... C11D 7/32 422/294
6,929,326 B2 * 8/2005 Cohen-Fyffe ..... A47C 31/11 297/219.12
7,260,853 B2 * 8/2007 Newman ..... A41D 31/00 2/55
7,374,182 B2 * 5/2008 Gurley ..... B62B 3/1464 280/33.993
7,398,977 B2 * 7/2008 Short ..... B62B 3/1464 280/651
8,011,024 B2 * 9/2011 Newman ..... A41D 31/00 2/202
8,012,554 B2 * 9/2011 Shelley ..... B65D 81/28 206/524.4
8,042,869 B2 * 10/2011 McClintock ..... B62B 3/1448 297/229
8,807,578 B1 * 8/2014 Huguley ..... B62B 3/1464 280/33.992
9,402,484 B2 * 8/2016 Moore ..... A47C 31/11
9,993,401 B2 * 6/2018 Barnett ..... A61K 8/8152
11,254,091 B2 * 2/2022 Conway ..... A45C 11/00
2001/0048235 A1 * 12/2001 Hartranft ..... B62B 3/1444 297/219.12
2005/0188450 A1 * 9/2005 Clark ..... A41D 13/1209 2/247
2005/0217048 A1 * 10/2005 Elie ..... A47K 10/02 15/209.1
2007/0183691 A1 * 8/2007 Finnegan ..... B65D 85/18 383/14
2008/0211280 A1 * 9/2008 Reynolds ..... B62B 3/144 297/256.17
2010/0125929 A1 * 5/2010 Conner ..... A41D 13/04 2/69
2012/0117708 A1 * 5/2012 Trapani ..... A41D 13/1209 442/377
2013/0167286 A1 * 7/2013 Hudson ..... A41F 9/00 2/300
2015/0259629 A1 * 9/2015 Jones ..... C11D 3/222 510/102
2016/0129819 A1 * 5/2016 Johnson, Jr. ..... B60N 2/5891 297/219.1
2016/0129927 A1 * 5/2016 Russell ..... B62B 5/069 29/525.01
2017/0030008 A1 * 2/2017 Calise ..... A45C 13/385
2017/0129521 A1 * 5/2017 Conroy ..... B62B 3/1448
2017/0246485 A1 * 8/2017 Barbeau ..... A41D 3/00
2018/0295912 A1 * 10/2018 Watts ..... A41D 13/0058
2022/0010482 A1 * 1/2022 Abrams ..... A45C 13/103

* cited by examiner

CART COAT FOR LAUNDROMAT CARTS AND ASSOCIATED SYSTEMS AND METHODS

FIELD OF THE INVENTION

Embodiments of the present invention relate to cart coats or covers that can be, but do not have to be, used for laundromat carts.

BACKGROUND

A laundromat (also known as a self-service laundry facility, a coin laundry facility, or a coin wash facility, among others) is a facility where clothes are washed and dried with limited or no personalized professional help. Laundromats are commonly found in various public settings such as shopping centers, stand-alone buildings, hospitals, residence halls at universities, apartment blocks, etc. Typically, the laundromat will include a number of washing machines and a number of drying machines that a customer can use as desired. Some laundromats offer carts for customers to use that are made out of metal wiring, plastics, etc. Such carts facilitate movement of clothes or other washed items from the washing machine to the drying machine and may be used to temporarily hold the clothes or other items while the customer is unloading them/preparing to wash them, while the customer is loading them/preparing to fold the items and leave the laundromat, etc. In addition, laundromat carts may be used by customers for non-washing purposes, such as toys for children to play on while the clothes are being washed, impromptu cribs for holding children while the clothes are being washed, etc.

Accordingly, due to their location and environment, laundromat carts are handled all day long by numerous people and are exposed to various items (clothes, toys, towels, and other items) in various states of cleanliness. Moreover, such continuous use of the carts and exposure to the various items to be cleaned reduces the usable life of the cart as the cart tends to rust or otherwise break down. As a result, some of these potential disease carrying surfaces may carry any kind of pathogen or health risk that may be contracted by the customer. A non-limiting example of various health-risks that are transmittable from surfaces of clothes, towels, toys, and other items commonly held in a laundromat cart include ringworm, impetigo, cellulitis, measles, rubella, scabies, lice, herpes, staph infections, molluscum contagiosum, erythema infectiosum, yeast infection, diaper rash, nail fungus, *Pityriasis rosea*, lymphangitis, follicultis, etc. Despite the laundry list of possible health risks, the surfaces of the laundromat cars are seldom, if ever, disinfected.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present disclosure, a cart coat includes an outer layer defining an inner surface and an outer surface of the cart coat, and the outer layer also defines a pouch. The cart coat also includes an inner layer retained within the pouch. The inner layer is detached from the outer layer and a health protection material. The cart coat may be adapted to seat within a laundromat cart.

According to some embodiments of the present disclosure, a method of assembling a cart coat includes positioning the cart coat in a basket of a laundromat cart such that an outer surface of the cart coat is adjacent to the basket of the laundromat cart. The cart coat includes an outer layer defining an inner surface and an outer surface of the cart coat. The outer layer defines a pouch. The cart coat also includes an inner layer retained within the pouch and having a health protection material. The method also includes detachably securing the cart coat to the basket.

According to various embodiments of the present disclosure, a cart coat transport system includes a cart coat and an article of apparel. The cart coat includes a base and a plurality of panels extending from the base. The base and plurality of panels define a receiving area of the cart coat, and top edges of the plurality of panels opposite from the base define an opening that provides access to the receiving area. The cart coat also includes a first attachment feature extending along at least a portion of the opening. The article of apparel may be configured to be worn on an upper part of a wearer's body when worn, and the article of apparel includes a surface with a second attachment feature along at least a portion of the surface. The first attachment feature is selectively engageable with the second attachment feature such that the cart coat is selectively attachable to the article of apparel.

According to some embodiments, a cart coat includes a base and at least one panel extending from the base. The base at the at least one panel define a receiving area, and an edge of the at least one panel opposite from the base defines an opening providing access to the receiving area. The cart coat includes a health protection material integrated with at least one of the base or the at least one panel.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
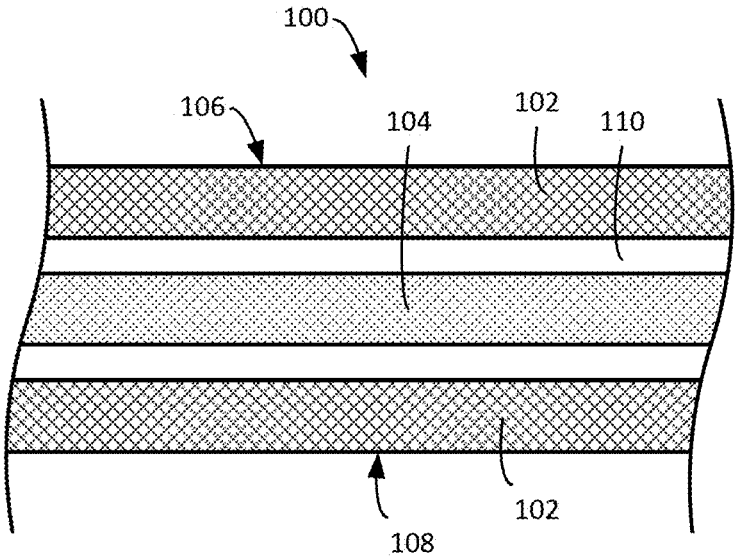
FIG. 1 is a sectional view of a portion of a cart coat according to aspects of the current disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Unless otherwise indicated, the patterns of the components illustrated in the figures are not intended to imply a particular material used to form the respective components but is instead merely provided to visually distinguish between the different components.

Embodiments of the present invention relate to cart coats (also referred to herein as "cart covers") that can be, but that does not have to be, used for laundromat carts. Cart coats provide protection against health-related threats found in laundromats and extend the usable life of the laundromat carts. In various embodiments, the cart coat is flexible and can be adjusted or changed from an initial, assembled shape or geometry to a desired shape or geometry. In certain aspects, the cart coat is adjustable from its initial shape or geometry such that the cart coat can accommodate different sized carts, accommodate different items, etc. In other examples, the cart coat has a flexible shape but may be assembled and disassembled as desired.

In various examples, a cart coat includes a flexible body having an outer layer defining a pouch, and at least one inner layer within the pouch. In certain examples, the outer layer is a porous material including, but not limited to, various fabrics made of natural or synthetic materials, various mesh material, waterproof materials, water resistant materials or fabrics including but not limited to canvas, vinyl, twill, burlap, bull denim, upholstery fabric, hemp, poly cotton, duck cloth, etc., various combinations thereof, or various other suitable materials. In some examples, the inner layer is an antiseptic liner that is configured to absorb various materials such as oils, fuels, petroleum-based products, water, coolants, etc. In certain cases, the liner is infused with various antibacterial/germicidal/antiseptic materials that kill and/or neutralize various germs or other pathogens. In some cases, the liner is optionally infused with various scent-effusing materials such that particular scents may be emitted from the cart liner.

In certain examples, the cart coat is removably positionable within a laundromat cart such that the cart coat can be removed as desired. Optionally, the cart coat is washable and/or cleanable such that the cart coat may be reused after proper cleaning. Optionally, the cart coat includes various attachment mechanisms for removably securing the cart coat relative to the laundromat cart. Suitable attachment mechanisms include, but are not limited to, zip or slide fasteners, hook and loop fasteners (such as Velcro®), snaps, buttons, clips, clasps, hooks, elastic bands, various combinations thereof, or various other suitable attachment mechanisms. In some optional embodiments, a top flap may be provided with the cart coat to cover the contents positioned within the cart coat. In such embodiments, the top flap may be detachably connected to the cart coat through any of the attachment mechanisms previously described. Optionally, handles may be provided with the cart coat to assist with removal or insertion of the cart coat from the laundromat cart.

In some cases, a cart coat transport system may include the cart coat and a piece of apparel on which the cart coat may be selectively attached. In various aspects, the cart coat transport system may facilitate transport of the cart coat (and contents of the cart coat) while also protecting the contents of the cart coat. As a non-limiting example, the cart coat transport system may be utilized to transport laundry to and from a laundromat and/or may be utilized by a food delivery service to transport food and/or perishable items from a store to a customer. The piece of apparel may be various suitable types of apparel as desired. In certain examples, the piece of apparel may be configured to be worn on an upper part of a wearer's body (e.g., at or above the wearer's waist), and may be various types of apparel including, but not limited to, jackets, sweatshirts, blouses, shirts, sweaters, etc.

Cart Coat

FIG. 1 illustrates a portion of a cart coat 100 having an outer layer 102 and an inner layer 104. As illustrated in FIG. 1, the outer layer 102 defines an inner surface 106 and an outer surface 108 of the cart coat 100. In some examples, the outer surface 108 is configured to contact the surface of a laundromat cart and the inner surface 106 defines a receiving area where clothes or other items may be positioned. See, e.g., FIGS. 5, 6, 8, and 9. Optionally, in some examples, the outer layer 102 may include a material such that the surfaces 106 and 108 are easy to clean (e.g., with disinfectant wipes or sprays or other suitable materials or cleaners). In other examples, a semi-hardening coat may be provided on the outer surface 108 and/or the inner surface 106 to provide additional protection to the cart coat 100. In various aspects, the semi-hardening coat may be a rate sensitive material that deforms easily when subjected to softer or lesser forces and stiffens under harder or higher forces.

In various examples, the outer layer 102 defines a pouch 110, and the inner layer 104 is positionable within the pouch 110. The pouch 110 may have various shapes and sizes as desired. In some examples, the pouch 110 extends beneath substantially the entire outer surface 108 and/or the inner surface 106, while in other examples, the pouch 110 may be defined in discrete locations between the inner surface 106 and the outer surface 108. In certain examples, a plurality of pouches 110 may be provided between the inner surface 106 and the outer surface 108, and each pouch may include an inner layer 104. As such, the number of pouches 110 should not be considered limiting on the current disclosure. In examples with a plurality of pouches 110, the type of inner layer 104 in one pouch may be the same as or different from the type of inner layer in another one of the pouches 110.

As described above, in some examples, the outer layer 102 may be constructed from various porous materials including, but not limited to, various fabrics made of natural or synthetic materials, various mesh material, various combinations thereof, or various other suitable materials that allow for restricted ingress and egress to the pouch 110. As some non-limiting examples, the outer layer 102 may be constructed from canvas, cotton, nylon, various other natural or synthetic polymers, various rubbers, urethane, vinyl, various mesh material, waterproof materials, water resistant materials or fabrics including but not limited to canvas, vinyl, twill, burlap, bull denim, upholstery fabric, hemp, poly cotton, duck cloth, etc., various other suitable materials. Optionally, various metals such as copper or zinc maybe incorporated into the outer layer 102 through weaving, stitching, adhesives, fasteners, other attachment mechanisms, etc.

In various examples, the outer layer 102 may have a visually distinct pattern provided on the inner surface 106 and/or the outer surface 108. In some examples, a visually distinct pattern of the inner layer 106 is different from a visually pattern of the outer layer 108, although it need not be. Furthermore, in some examples, the inner layer 106 and/or outer layer 108 may have different regions with different visually distinct patterns. The visually distinct pattern may be integrated into the outer layer 102 and applied onto the outer layer 102 through various suitable mechanisms. In certain cases, the visually distinct pattern may include various colors, decals, lines, graphics, stickers, chevrons, swirls, etc. In some cases, the visually distinct pattern is provided such that a particular laundromat cart with a customer's items may be easily identified in the laundromat.

In some examples, the inner layer 104 is permanently retained within the pouch 110, meaning that the inner layer 104 cannot be removed from the pouch 110 without significant modification to the cart coat 100 (e.g., by tearing or cutting the outer layer 102). In such examples, the inner layer 104 and outer layer 102 may optionally be cleaned together after a predetermined time period and returned to use.

In other examples, outer layer 102 includes an opening providing access to the pouch 110, and various closure mechanisms may be provided adjacent to the opening such that the opening may be opened or closed as desired. Various suitable closure mechanisms include, but are not limited to, zip fasteners, clips, clasps, hooks, hook and loop fasteners, buttons, etc. When the opening is included, the opening may be defined in the inner surface 106, in the outer surface 108, or an opening may be defined in both the inner surface 106 and the outer surface 108. In examples where the inner layer 104 is removable from the pouch 110, the inner layer 104 and outer layer 102 may optionally be cleaned together or separately after a predetermined time period and returned to use. In some examples and as described below, the inner layer 104 may be a single use layer and/or may need cleaning at a different frequency than the outer layer 102. In such cases, the opening may allow for the inner layer 104 to be changed as needed.

The inner layer 104 may selectively absorb various materials such as oils, fuels, petroleum-based products, water, coolants, etc. Additionally or alternatively, the inner layer 104 may selectively kill and/or neutralize various germs or other pathogens. The inner layer 104 may be constructed from various suitable absorbent materials including, but not limited to various natural or synthetic polymers such as wool, silk, natural rubber, cellulose, polypropylene, polyethylene, synthetic rubber, nylon, various other suitable materials and/or combination of materials. In some examples, the inner layer 104 is configured to absorb and/or kill germs or other pathogens that penetrate through the inner surface 106 and the outer surface 108.

Figure 2:
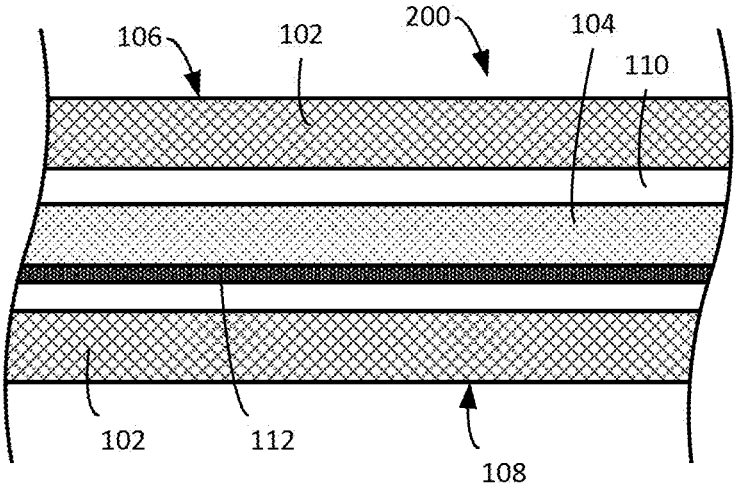
FIG. 2 is sectional view of portion of another cart coat according to aspects of the current disclosure.

In other examples, as illustrated in FIG. 2, the inner layer 104 of a cart coat 200 includes a backing 112 that creates an additional barrier if desired. Optionally, the backing 112 directs the absorption/antiseptic effectiveness to a single direction (e.g., in FIG. 2, towards the inner surface 106). In certain aspects, the backing 112 may be breathable (vapor permeable) but fluid impermeable. In some non-limiting examples, the backing 112 may include various materials such as polyethylene, polyurethane, wool, nylon, In various aspects, the inner layer 104 attracts germs and/or other contaminants to itself. As some non-limiting examples, the inner layer 104 may be an oil sorbent pad or other suitable inner layer.

In some cases, the inner layer 104 (and/or the outer layer 102) is infused with various antibacterial, antimicrobial, germicidal, and/or antiseptic materials (collectively referred to as a "health protection material") that kill and/or neutralize various germs or other pathogens. In some embodiments, the health protection materials include a solution, such as an oil solution. As one non-limiting example, the oil solution may be a wheat germ carrier oil mixture comprising about 10% wheat germ oil (ajwain and menthol crystals) and about 90% sweet almond oil, grapeseed oil, or jojoba oil. In other examples, other concentrations of the wheat germ oil may be utilized. As another non-limiting example, a germicide oil, which may be a blend of the wheat germ carrier oil mixture with another oil, may be infused in the inner layer 104. In some examples, the germicide oil includes a mixture 80 drops of an essential oil to 4 ounces of the wheat germ carrier oil mixture.

In certain non-limiting examples, the essential oil may include various essential oils such as Peruvian balsam, sandalwood, benzoin, patchouli, niaouli, hyssop, and/or cajuput. In other non-limiting examples, the essential oil may be a blend or solution of various base note, middle note, and/or top note essential oils. In some cases, the base note essential oils include, but are not limited to, Peruvian balsam, sandalwood, patchouli, benzoin, myrrh, ylang-ylang, vetiver, frankincense, camphor, or other suitable base note essential oils. In various examples, the middle note essential oils include, but are not limited to, niaouli, hyssop, cinnamon, oregano, geranium, lavender, juniper, clary sage, thyme, rosemary, ginger, marjoram (sweet mild), blue yarrow, scotch pine, bay laurel, winter savory, nutmeg, fennel, anise, hops, carrot seed, terebinth, elemi, cypress, St. John's wort, black pepper, chamomile, rose, jasmine, or other suitable middle note essential oils. In various examples, the top note essential oils include, but are not limited to, cajuput, eucalyptus, peppermint, lemongrass, tea tree, sage, clove (eugenol), basil, mandarin, bergamot, citronella, lime peel, lemon, spearmint, lemon balm, or other suitable top note essential oils. In one non-limiting example, the 80 drops of the essential oil include 10 drops of Peruvian balsam, 10 drops of sandalwood, 5 drops of benzoin, 5 drops of patchouli, 15 drops of niaouli, 15 drops of hyssop, and 20 drops of cajuput. Various other concentrations and/or mixtures may be utilized. In some cases, a stronger solution has a higher concentration of the base note essential oils, a milder solution has a higher concentration of the middle note essential oils, and a basic solution has a higher concentration of the top note essential oils.

In some cases, various other non-oils maybe provided with the inner layer 106 (and/or the outer layer 102) (e.g., through infusion, as an extract, etc.). Such non-oils include, but are not limited to, damiana, papain, woundwort, elecampane, forsythia, rose pepper, oak, cornflower, cannabis, beech, oak moss, pyrogenium, sangre de drago, achiote, garlic, meadowsweet, uva ursi, osha, wild indigo, menthol crystals, dog's mercury, carnation, lemon verbena, prickly ash, baptisia, chrysanthemum, buchu, hypericum, mugwort, calendula, ledum, daikon radish sprouting seed, willow bark (white willow), bay leaf, cramp bark, sulfur, cardamoms, black walnut, olive leaf, Oregon grape root, goldenseal, or various other suitable non-oils.

Figure 3:
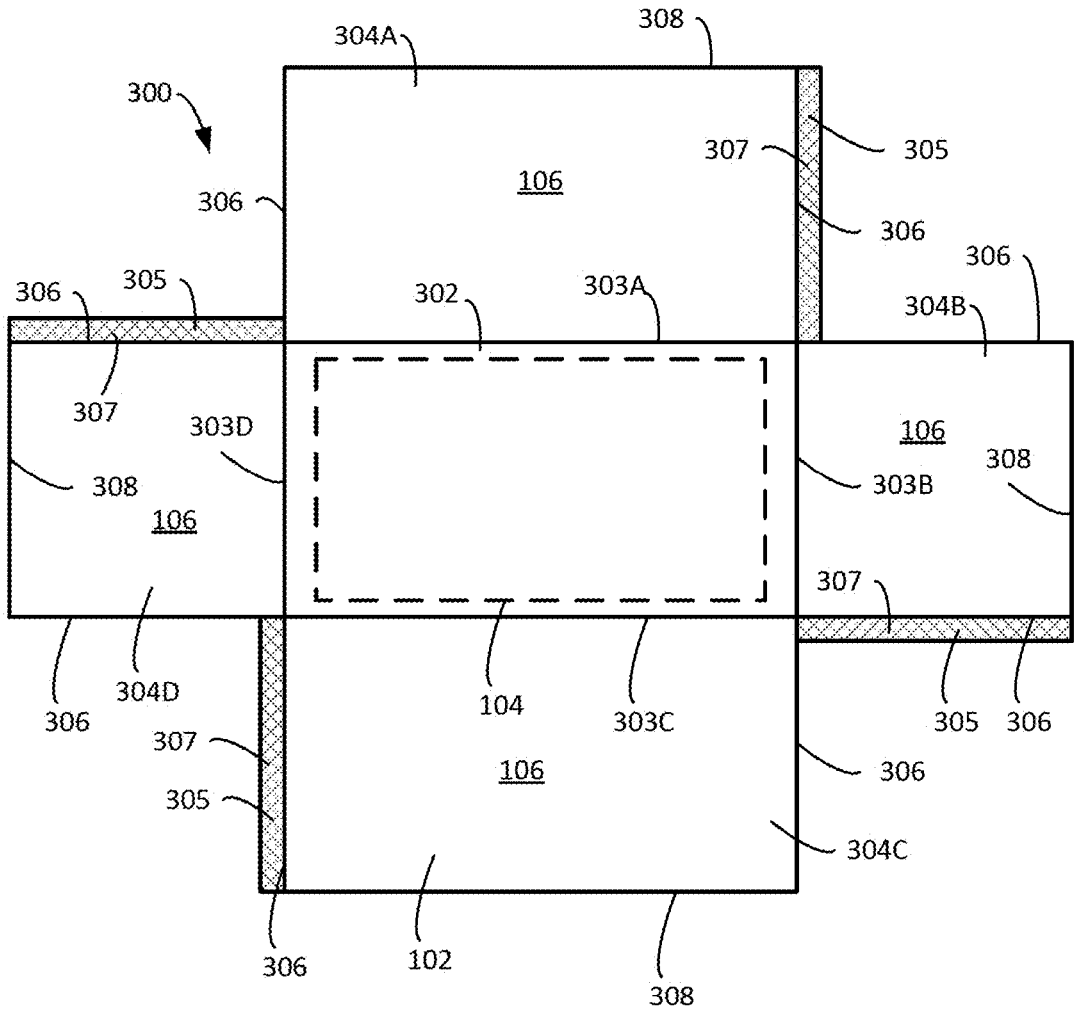
FIG. 3 is top view of an example of a cart coat in a disassembled configuration according to aspects of the current disclosure.
Figure 4:
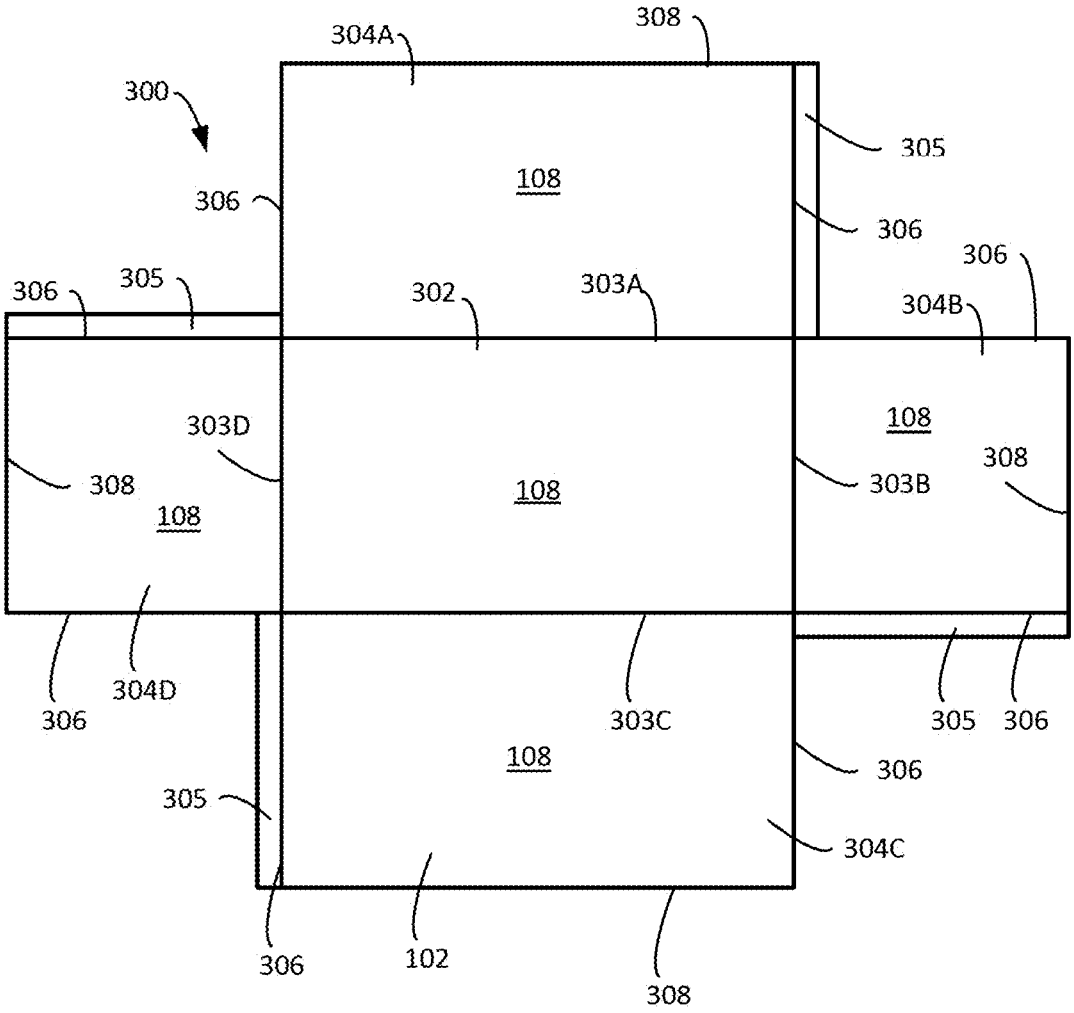
FIG. 4 is a bottom view of the cart coat of FIG. 3 in the disassembled configuration.

FIGS. 3 and 4 illustrate another example of a cart coat 300 that is substantially similar to the cart coat 100 and includes the outer layer 102 and the inner layer 104 (partially shown in dashed lines in FIG. 3). FIGS. 3 and 4 illustrate the cart coat 300 in a disassembled configuration. In some examples, the disassembled cart coat 300 includes a base 302 and side panels 304A-D. The base 302 and/or side panels 304A-D may have a construction as described above with reference to FIGS. 1 and 2. The shape of the base 302, the shape of the side panels 304, and the number of side panels 304 should not be considered limiting on the current disclosure. In some cases, the shape of one side panel 304 may be different from the shape of another side panel 304, although it need not. As one non-limiting example, a top edge 308 of each panel opposite from the base 302 (e.g., the edge that forms a top edge of the cart coat 300 when assembled) may be longer than the portion of the panel adjacent and/or attached to the base 302 such that a perimeter of the top edge of the cart coat 300 is greater than a perimeter of the base 302. In various examples, the side panels 304 are connected to the base 302 through sewing, stitching, fasteners, or various other suitable mechanical or chemical mechanisms. In other examples, the side panels 304 are integrally formed with the base 302, and a bend region separates the side panels 304 from the base 302. In the example of FIGS. 3 and 4, the side panels 304 are integrally formed with the base 302, and bend regions 303A-D separate the side panels 304A-D from the base 302.

As illustrated in FIGS. 3 and 4, each side panel 304A-D includes side edges 306 and a top edge 308. In certain examples, adjacent side edges 306 of adjacent side panels 304A-D (e.g., adjacent side edges 306 of side panels 304A and 304B) are joined together to put the cart coat 300 in the assembled configuration (discussed below with reference to FIGS. 5 and 6). In some examples, the adjacent side edges 306 are permanently joined through sewing, stitching, adhesives, or various other suitable mechanical or chemical mechanisms such that once assembled, the cart coat 300 remains in the assembled configuration. In other examples, the adjacent side edges 306 are detachably joined through zip fasteners, clips, clasps, buttons, hooks, hook and loop fasteners, drawstrings, pins, or other suitable mechanical or chemical mechanisms such that the cart coat 300 is selectively changeable between the disassembled configuration and the assembled configuration.

Optionally, each side panel 304 may include an attachment panel 305 that extends along at least one of the side edges 306. The attachment panel 305 may be continuous with the side panels 304 or may be separate components attached to the side panels 304. In various aspects, the attachment panels 305 may facilitate the joining of adjacent side panels 304 and may help the cart coat maintain its shape in the assembled configuration. In the example of FIGS. 3 and 4, each attachment panel 305 includes hook and loop fasteners 307 as an attachment mechanism such that the adjacent side panels 304 can be selectively attached or detached, thereby allowing for the cart coat 300 to be selectively changeable between the disassembled configuration and the assembled configuration. In other examples, various other types of attachment mechanisms other than hook and loop fasteners may be utilized, including, but not limited to, pins, clips, clasps, buttons, zip fasteners, or other suitable mechanisms.

Figure 6:
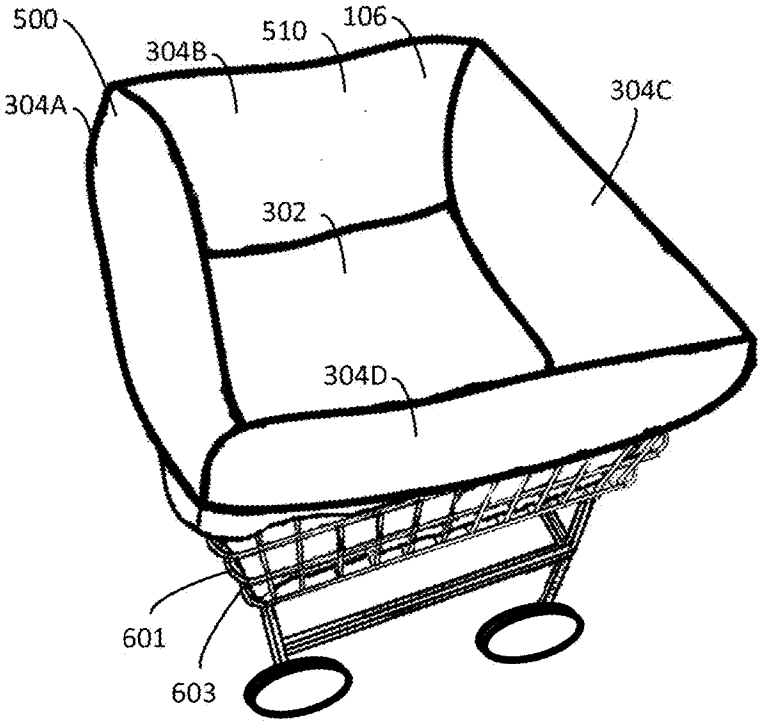
FIG. 6 is a perspective view of the cart coat of FIG. 5 in a laundry cart.
Figure 5:
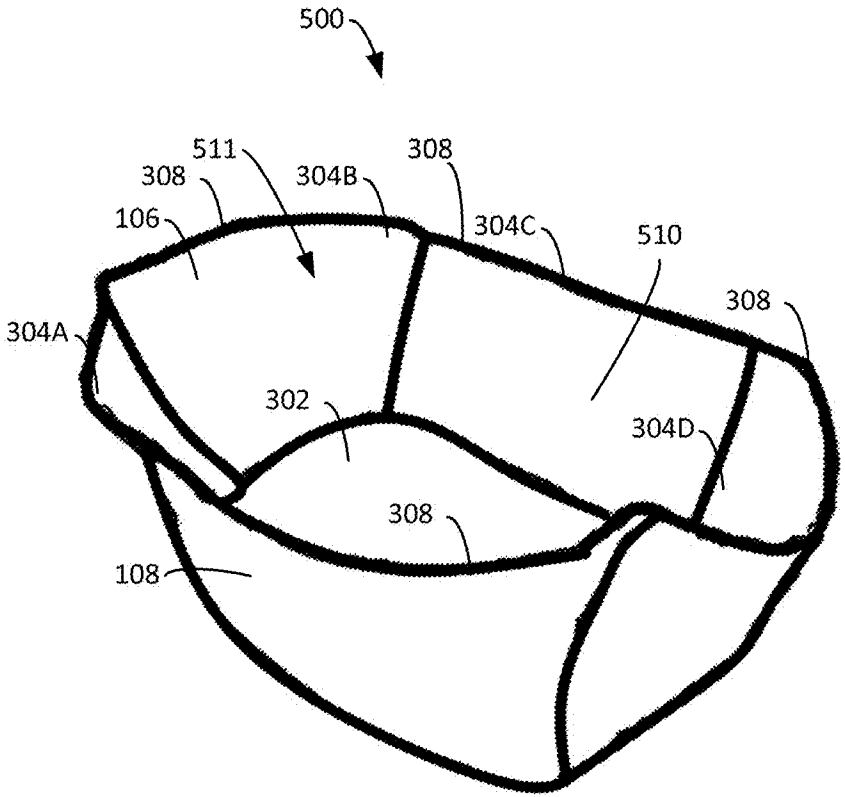
FIG. 5 is a perspective view of an assembled cart coat according aspects of the current disclosure.

FIGS. 5 and 6 illustrate another example of a cart coat 500. The cart coat 500 is substantially similar to the cart coats 100 and 300 and includes the outer layer 102 and the inner layer (not visible in FIGS. 5 and 6). Compared to the cart coat 300 of FIGS. 3 and 4, the cart coat 500 of FIGS. 5 and 6 is in the assembled configuration. Referring to FIG. 5, in the assembled configuration, the inner surface 106 of the cart coat 500 defines a receiving area 510 for the customer's items (clothes, towels, toys, food, other perishable items, other items, etc.). The top edges 308 of the side panels 304 may define an opening 511 that provides access to the receiving area 510. In various aspects, a perimeter of the opening 511 may be greater than a perimeter of the base 302, although it need not be in other examples. The cart coat 500 in the assembled configuration may have a rigid or semi-rigid shape, meaning that it generally maintains its shape regardless of the shape or surface on which the cart coat 500 is positioned. In other examples, the cart coat 500 may have a flexible shape, meaning that it maintains its general shape, but the panels 304 and/or base 302 are movable relative to each other such that the cart coat 500 can better conform to a shape of the laundry cart or surface on which the cart coat 500 is supported. In various examples, the cart coat 500 in the assembled configuration may be self-supporting, meaning that it can substantially remain in the assembled configuration without requiring additional components or support.

As illustrated in FIG. 6, the cart coat 500 is removably positionable within a laundry cart 601 such that the outer surface 108 is adjacent to the surface of a basket 603 of the laundry cart 601. In some non-limiting examples, the top edges 308 are foldable over a top edge of the basket 603 to provide a barrier between the top edge (and other portions) of the basket 603 and the user during use. In some examples, the top edges 308 or portions of the top edges 308 may be selectively foldable to cover the opening 511 and provide further protection against the surfaces of the laundry cart 601, although they need not in other examples. In some cases, the cart coat 500 is detachably secured relative to the laundry cart 601 through hooks, pins, clips, clasps, buttons, hook and loop fasteners, drawstrings, elastic bands, or other suitable mechanisms.

Figure 7:
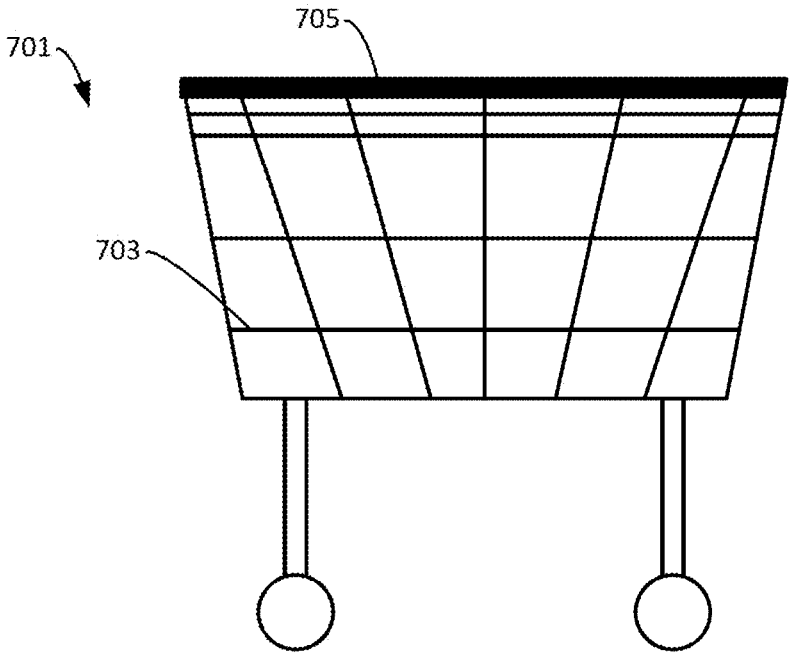
FIG. 7 is a side view of an example of a laundry cart.
Figure 8:
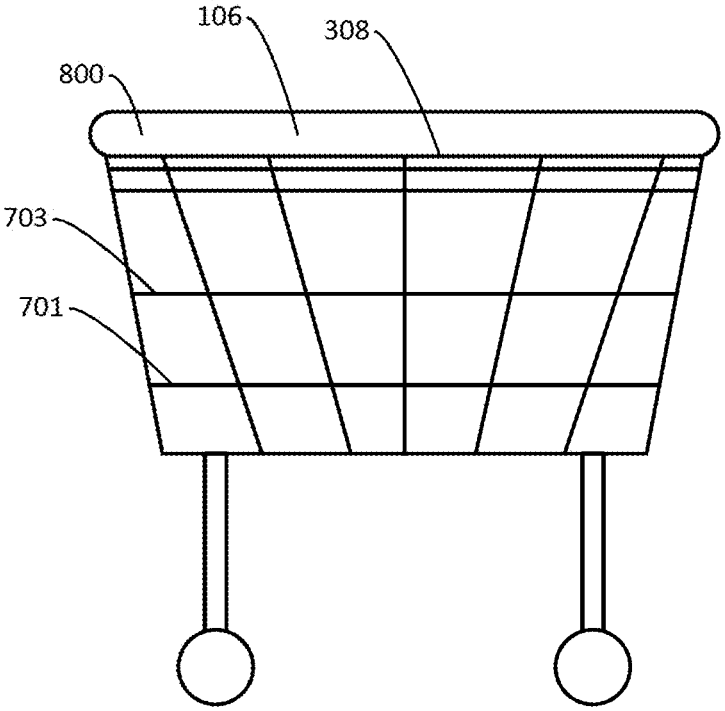
FIG. 8 is a side view of the laundry cart of FIG. 7 with a cart coat according to aspects of the current disclosure positioned therein.

FIG. 7 illustrates another example of a laundry cart 701 that includes a basket 703 having a top edge 705. FIG. 8 illustrates an example of a cart coat 800 that is substantially similar to the previously discussed cart coats and that is positioned within the basket 703. As illustrated in FIG. 8, the top edges 308 of the cart coat 800 are folded over the top edge 705 of the basket 703 such that the cart coat 800 provides a barrier between the top edge 705 (and other portions) of the basket 703 and the user during use. In the example of FIG. 8, an elastic band is provided with the cart coat 800 adjacent to the top edges 308 to detachably secure the cart coat 800 to the laundry cart 701.

Figure 9:
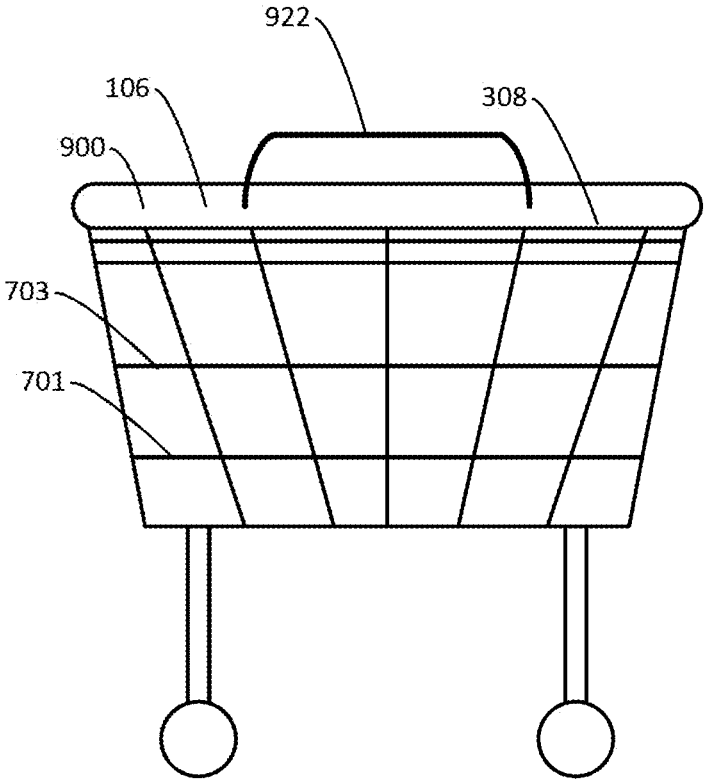
FIG. 9 is a side view of the laundry cart of FIG. 7 with another cart coat according to aspects of the current disclosure positioned therein.

FIG. 9 illustrates an example of a cart coat 900 positioned in the basket 703 of the laundry cart 701. The cart coat 900 is substantially similar to the cart coat 700 except that the cart coat 900 includes at least one handle 922 at or proximate to the top edge 308 of one or more of the side panels 304. In the example of FIG. 9, the handle 922 is provided on the inner surface 106 of the cart coat 900, although the location should not be considered limiting on the current disclosure.

In some optional examples, a top flap (not shown) extends from one or more of the side panels 304. In various aspects, the top flap is configured to selectively cover the receiving area 510. In some aspects, the top flap is detachably secured to another top flap and/or side panel 304 through hook and loop fasters, clips, clasps, hooks, pins, buttons, elastic bands, drawstrings, zip fasteners, or various other suitable mechanisms.

Cart Coat Transport System

In some examples, a cart coat transport system may include a cart coat as described herein and a piece of apparel on which the cart coat may be selectively attached. In various aspects, the cart coat transport system may facilitate transport of the cart coat (and contents of the cart coat) while also protecting the contents of the cart coat.

FIGS. 10-15 illustrate an example of a cart coat transport system 1024 according to aspects of the current disclosure. The cart coat transport system 1024 includes a cart coat 1000 and a piece of apparel 1026.

Figure 13:
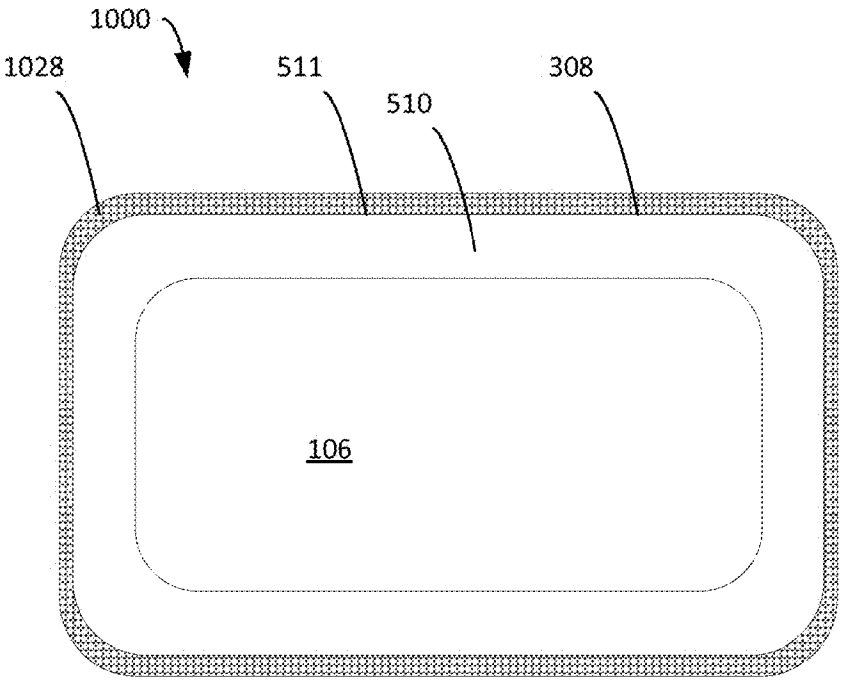
FIG. 13 is a top view of the cart coat of the cart coat transport system of FIG. 10.

The cart coat 1000 may be substantially similar to the cart coats described herein except that the cart coat 1000 additionally includes an attachment feature 1028 (see FIG. 13). In some examples, the attachment feature 1028 extends along at least a portion of the opening 511 of the cart coat 1000. In the example of FIGS. 10-15, the attachment feature 1028 extends along an entire perimeter of the opening 511, although in other examples the attachment feature 1028 may extend along a portion of the opening 511 that is less than the entire perimeter. The attachment feature 1028 may be various suitable mechanisms or features that selectively engage the apparel 1026 such that the cart coat 1000 can be selectively attached to or detached from the apparel 1026. Various suitable attachment features include, but are not limited to, hook and loop fasteners, pins, hooks, clips, clasps, buttons, zip fastener, adhesives, etc. In the example of FIGS. 10-15, the attachment feature 1028 includes hook and loop fasteners.

The apparel 1026 may be various types of apparel as desired. In certain examples, the apparel 1026 may be configured to be worn on an upper part of a wearer's body (e.g., at or above the wearer's waist), and may be various types of apparel including, but not limited to, jackets, sweatshirts, blouses, shirts, sweaters, etc. In the example of FIGS. 10-15, the apparel 1026 is a jacket.

Figure 11:
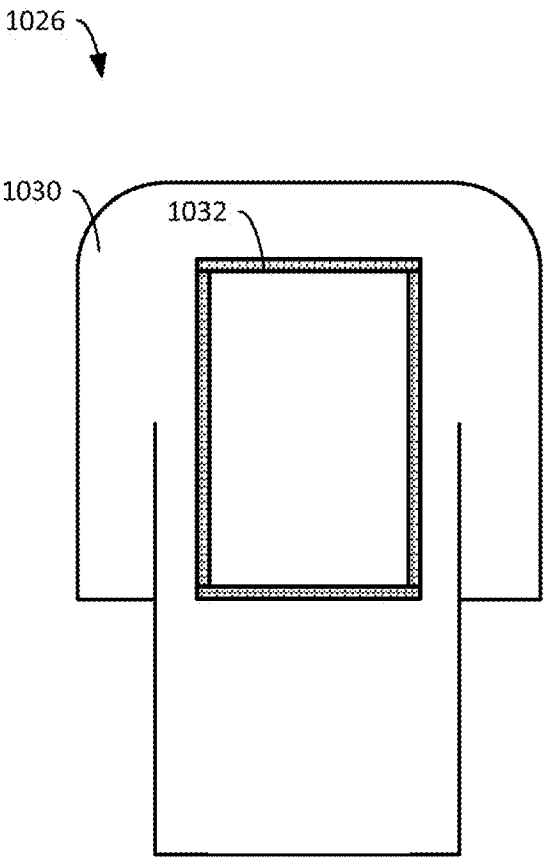
FIG. 11 is a rear view of the piece of apparel of the cart coat transport system of FIG. 10.
Figure 10:
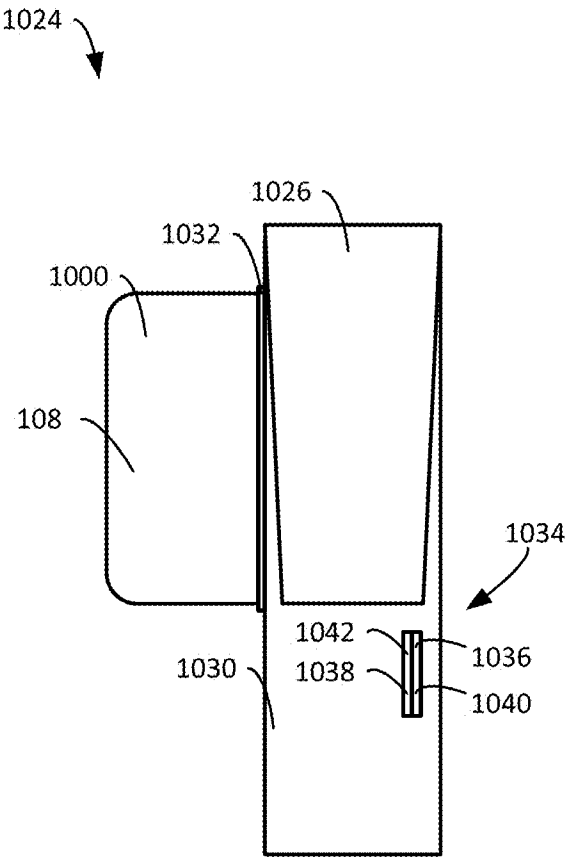
FIG. 10 is a side view of a cart coat transport system according to aspects of the current disclosure, the cart coat system including a cart coat and a piece of apparel.
Figure 12:
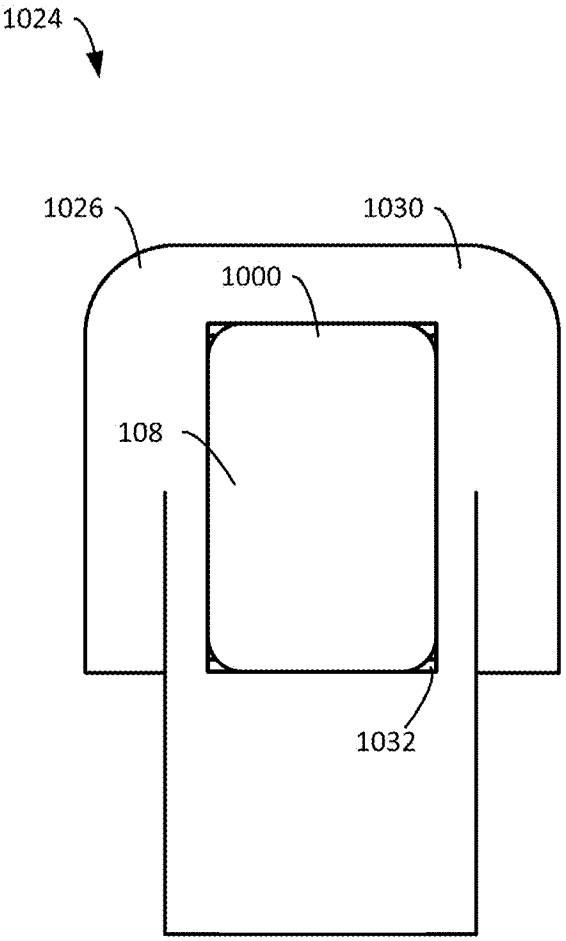
FIG. 12 is a rear view of the cart coat transport system of FIG. 10.

As best illustrated in FIGS. 10-12, in some examples, a portion of a surface 1030 of the apparel 1026 may include an attachment feature 1032 that engages with the attachment feature 1028 to selectively attach the coat cover 1000 on the apparel 1026. In some examples, the attachment feature 1032 may be provided on a particular side (e.g., front side, back side, etc.) of the apparel 1026 as desired. In the example of FIGS. 10-15, the attachment feature 1032 is provided on the back side of the apparel 1026. The attachment feature 1032 may be various suitable mechanisms that selectively cooperate with the attachment feature 1028, including, but not limited to, hook and loop fasteners, pins, hooks, clips, clasps, buttons, zip fastener, adhesives, etc. In the example of FIGS. 10-15, the attachment feature 1032 includes hook and loop fasteners. In particular, in the example of FIGS. 10-15, the attachment feature 1028 may include hooks and the attachment feature 1032 may include loops or vice versa.

Figure 15:
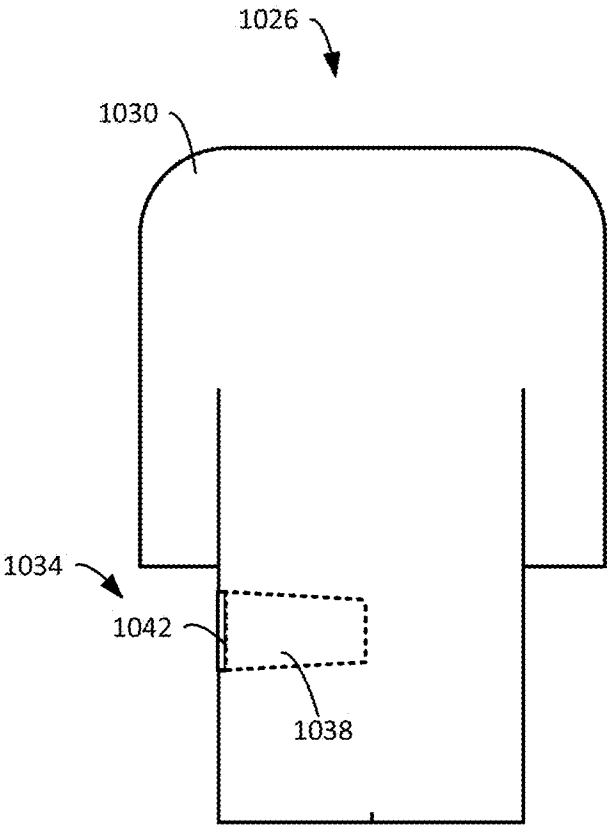
FIG. 15 is another front view of the piece of apparel of the cart coat transport system of FIG. 10.
Figure 14:
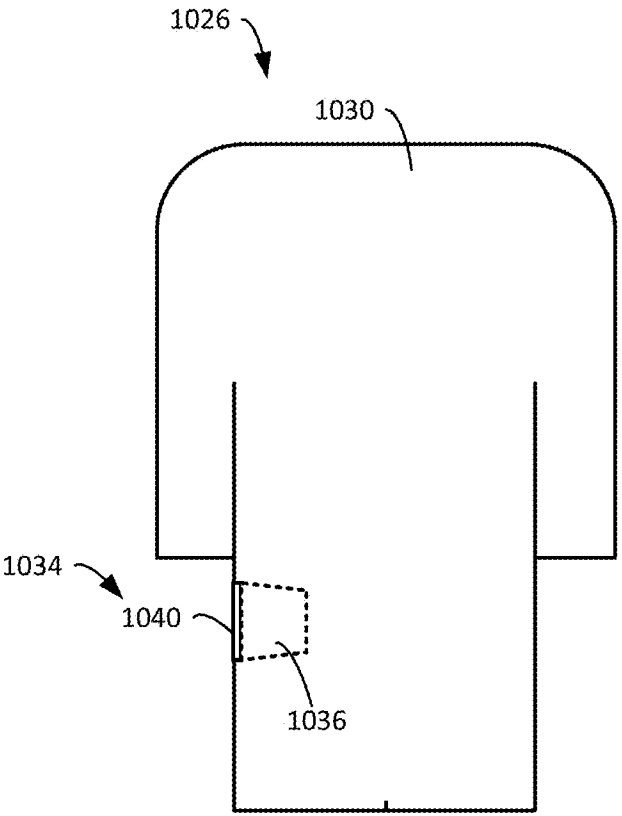
FIG. 14 is a front view of the piece of apparel of the cart coat transport system of FIG. 10.

Optionally, and as best illustrated in FIGS. 10, 14, and 15, the apparel 1026 may include a double pocket 1034 that has a main pocket 1036 and a security pocket 1038. The number of double pockets 1034 included on the apparel 1026 should not be considered limiting on the current disclosure. In FIG. 14, the security pocket 1038 is omitted for clarity of the main pocket 1036, and in FIG. 15 the main pocket 1036 is omitted for clarity of the security pocket 1038. As best illustrated in FIG. 10, the main pocket 1036 may have a main pocket opening 1040 and the security pocket 1038 may have a security pocket opening 1042 that is adjacent to the main pocket opening 1040. In various aspects, the security pocket 1038 and the main pocket 1036 may be assembled such that the security pocket 1038 is closer to the body of the user when the apparel 1026 is worn, although it need not be in other cases. In some cases, the positioning of the security pocket opening 1042 relative to the main pocket opening 1040 may at least partially conceal the security pocket opening 1042 and/or create the appearance of a single pocket opening.

As best illustrated in FIGS. 14 and 15, in some cases, the security pocket 1038 has a shape and/or profile that may be different from a shape and/or profile of the main pocket 1036. In the example of FIGS. 10-15, the security pocket 1038 is elongated relative to the main pocket 1036. In certain aspects, the security pocket 1038 having the different shape and/or profile may allow for secure storage of a personal item (e.g., wallet, phone) and/or for the secure storage of a personal safety device (e.g., pepper spray, whistle, etc.) as desired. The security pocket 1038 may minimize the visual appearance of the item within the security pocket 1038 because it is behind the main pocket 1036 and/or closer to the body of the wearer. In certain aspects, the security pocket 1038 may be include an elastic or compressible material that may secure and limit movement of contents of the security pocket 1038 compared to the main pocket 1036. In some cases, the security pocket 1038 and/or the main packet 1036 may optionally have a closure mechanism. Various suitable closure mechanisms may be utilized for the security pocket 1038 and/or the main pocket 1036, including, but not limited to, hook and loop fasteners, clips, clasps, buttons, hooks, pins, buttons, combinations thereof, or other suitable devices or mechanisms as desired.

Examples

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. A cart coat comprising: an outer layer defining an inner surface and an outer surface of the cart coat, wherein the outer layer defines a pouch; and an inner layer retained within the pouch, wherein the inner layer is detached from the outer layer, wherein the inner layer comprises a health protection material, wherein the cart coat is adapted to seat within a laundromat cart.

Example 2. The cart coat of any preceding or subsequent examples or combination of examples, wherein the outer layer comprises a porous material.

Example 3. The cart coat of any preceding or subsequent examples or combination of examples, wherein the health protection material comprises an antiseptic material, wherein the antiseptic material comprises a germicide oil, and wherein the germicide oil comprises a solution of a wheat germ carrier oil mixture and an essential oil.

Example 4. The cart coat of any preceding or subsequent examples or combination of examples, wherein the essential oil comprises a solution of a base note essential oil, a middle note essential oil, and a top note essential oil.

Example 5. The cart coat of any preceding or subsequent examples or combination of examples, wherein the cart coat is configured to detachably connect to the laundromat cart.

Example 6. The cart coat of any preceding or subsequent examples or combination of examples, wherein the inner layer is selectively removable from the pouch.

Example 7. The cart coat of any preceding or subsequent examples or combination of examples, wherein the inner layer is permanently retained within the pouch.

Example 8. The cart coat of any preceding or subsequent examples or combination of examples, wherein the inner layer is a liner configured to absorb a fluid.

Example 9. The cart coat of any preceding or subsequent examples or combination of examples, wherein the outer layer comprises canvas, cotton, nylon, plastic, rubber, urethane, or vinyl.

Example 10. The cart coat of any preceding or subsequent examples or combination of examples, wherein the outer layer defines a base and a plurality of side panels extending from the base.

Example 11. A method of assembling a cart coat comprising: positioning the cart coat in a basket of a laundromat cart such that an outer surface of the cart coat is adjacent to the basket of the laundromat cart, wherein the cart coat comprises an outer layer defining an inner surface and an outer surface of the cart coat, wherein the outer layer defines a pouch, and wherein the cart coat further comprises an inner layer retained within the pouch and comprising an antiseptic material; and detachably securing the cart coat to the basket.

Example 12. The method of any preceding or subsequent examples or combination of examples, wherein detachably securing the cart coat to the basket comprises securing the cart coat with an elastic band, drawstring, hook and loop fastener, fly fastener, or snap fastener.

Example 13. A cart coat transport system comprising: a cart coat comprising a base and a plurality of panels extending from the base, wherein the base and plurality of panels define a receiving area of the cart coat, wherein top edges of the plurality of panels opposite from the base define an opening that provides access to the receiving area, and wherein the cart coat further comprises a first attachment feature extending along at least a portion of the opening; and an article of apparel configured to be worn on an upper part of a wearer's body when worn, wherein the article of apparel comprises a surface, wherein the article of apparel further comprises a second attachment feature along at least a portion of the surface of the article of apparel, and wherein the first attachment feature is selectively engageable with the second attachment feature such that the cart coat is selectively attachable to the article of apparel.

Example 14. The cart coat transport system of any preceding or subsequent examples or combination of examples, wherein the article of apparel comprises at least one of a shirt, a blouse, a jacket, or a sweater.

Example 15. The cart coat transport system of any preceding or subsequent examples or combination of examples, wherein the article of apparel further comprises a double pocket comprising a main pocket and a security pocket, and wherein a profile of the security pocket is different from a profile of the main pocket.

Example 16. The cart coat transport system of any preceding or subsequent examples or combination of examples, wherein the main pocket comprises a main pocket opening, wherein the security pocket comprises a security pocket opening, and wherein the main pocket opening is adjacent to the security pocket opening.

Example 17. The cart coat transport system of any preceding or subsequent examples or combination of examples, wherein the security pocket is arranged relative to the main pocket such that the security pocket is configured to be closer to a user when the article of apparel is worn.

Example 18. The cart coat transport system of any preceding or subsequent examples or combination of examples, wherein the cart coat comprises: an outer layer defining an inner surface and an outer surface of the cart coat, wherein the outer layer defines a pouch; and an inner layer retained within the pouch but not attached directly to the outer layer, wherein the inner layer comprises an antiseptic material, wherein the outer layer defines the base and the plurality of panels.

Example 19. The cart coat transport system of any preceding or subsequent examples or combination of examples, wherein the inner layer is selectively removable from the pouch.

Example 20. The cart coat transport system of any preceding or subsequent examples or combination of examples, wherein the plurality of panels are movable relative to the base such that a shape of the receiving area is adjustable.

Example 21. A cart coat comprising: a flexible body comprising a base and at least one panel extending from the base, wherein the base at the at least one panel define a receiving area, wherein an edge of the at least one panel opposite from the base defines an opening providing access to the receiving area, wherein the cart coat comprises a health protection material integrated with at least one of the base or the at least one panel, and wherein the at least one panel is movable relative to the base while maintaining the receiving area.

Example 22. The cart coat of any preceding or subsequent examples or combination of examples, wherein the health protection material comprises an antiseptic material, wherein the antiseptic material comprises a germicide oil, and wherein the germicide oil comprises a solution of a wheat germ carrier oil mixture and an essential oil.

Example 23. The cart coat of any preceding or subsequent examples or combination of examples, wherein the base and the at least one panel are integrally formed and a bend line separates the at least one panel from the base.

Example 24. The cart coat of any preceding or subsequent examples or combination of examples, wherein the at least one panel is detachable from the base.

Example 25. The cart coat of any preceding or subsequent examples or combination of examples, wherein the at least one panel comprises a plurality of panels.

Example 26. The cart coat of any preceding or subsequent examples or combination of examples, wherein at least one of the base or the at least one panel comprises an outer layer defining a pouch between an inner surface and an outer surface of the cart coat.

Example 27. The cart coat of any preceding or subsequent examples or combination of examples, further comprising an inner layer positioned within the pouch, and wherein the inner layer comprises the health protection material.

Example 28. The cart coat of any preceding or subsequent examples or combination of examples, wherein the inner layer is removable from the pouch.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

That which is claimed:

1. A protection device comprising:

an outer layer defining an inner surface and an outer surface of the protection device, wherein the outer layer defines a pouch between the inner surface and the outer surface of the protection device, wherein the inner surface of the outer layer at least partially defines a base portion and a sidewall portion of the protection device, wherein the sidewall portion comprises a perimeter edge, wherein the base portion and the sidewall portion of the inner surface defines a receiving area, and wherein the perimeter edge of the sidewall portion defines an opening to the receiving area; and an inner layer positionable within the pouch, wherein the inner layer is detached from the outer layer, wherein the inner layer comprises an antiseptic material, wherein the protection device is adapted to seat within a container, wherein the pouch is a first pouch, and wherein the protection device further comprises a plurality of pouches on the outer layer, wherein each pouch comprises an opening, and wherein each opening comprises a closure mechanism.

2. The protection device of claim 1, wherein the inner layer comprises a porous material.

3. The protection device of claim 1, wherein the antiseptic material comprises a germicide oil, and wherein the germicide oil comprises a solution of a wheat germ carrier oil mixture and an essential oil, and wherein the essential oil comprises a solution of a base note essential oil, a middle note essential oil, and a top note essential oil.

4. The protection device of claim 1, wherein the protection device is adapted to seat within a container, and wherein the protection device is configured to detachably connect to the container.

5. The protection device of claim 1, wherein the inner layer is selectively removable from the pouch or permanently retained within the pouch.

6. The protection device of claim 1, wherein the inner layer is a liner configured to absorb a fluid.

7. The protection device of claim 1, wherein the outer layer comprises canvas, cotton, nylon, plastic, rubber, urethane, hemp, natural materials, synthetic materials, or vinyl.

8. The protection device of claim 1, wherein the perimeter edge of the sidewalls further comprise an attachment feature extending from the perimeter edge.

9. The protection device of claim 1, wherein the outer layer of the protection device further comprises an antibacterial metal within the outer layer, and wherein the metal comprises at least one of copper or zinc.

10. A protection device comprising:

an outer layer defining an inner surface and an outer surface of the protection device, wherein the outer layer defines a pouch between the inner surface and the outer surface of the protection device, wherein the inner surface of the outer layer at least partially defines a base portion and a sidewall portion of the protection device, wherein the sidewall portion comprises a perimeter edge, wherein the base portion and the sidewall portion of the inner surface defines a receiving area, and wherein the perimeter edge of the sidewall portion defines an opening to the receiving area; and an inner layer positionable within the pouch, wherein the inner layer is detached from the outer layer, wherein the inner layer comprises an antiseptic material, wherein the protection device is adapted to seat within a laundromat cart, wherein the outer layer of the protection device further comprises an antibacterial metal within the outer layer, and wherein the metal comprises copper or zinc, and wherein the antibacterial metal is configured to contact a surface of the laundromat cart.

* * * * *